US005554011A

United States Patent [19]

Bales et al.

[11] Patent Number: 5,554,011

[45] Date of Patent: Sep. 10, 1996

[54] MEDICAL FLUID PUMP POWERED BY A CONSTANT SOURCE OF VACUUM

[75] Inventors: Thomas O. Bales, Miami; Matthew S. Solar, Cooper City; Robert Sixto, Jr., Miami; Kevin W. Smith, Coral Gables, all of Fla.

[73] Assignee: Symbiosis Corporation, Miami, Fla.

[21] Appl. No.: 330,370

[22] Filed: Oct. 27, 1994

[51] Int. Cl.[6] ..... F04B 17/00

[52] U.S. Cl. ..... 417/399; 417/402; 91/341 R

[58] Field of Search ..... 417/395, 399, 417/401, 402; 60/370; 91/341 R, 344

[56] References Cited

U.S. PATENT DOCUMENTS

| | | | |
|---|---|---|---|
| 1,390,617 | 9/1921 | Jay | 417/401 |
| 2,684,632 | 7/1954 | Horton | 417/402 |
| 3,134,304 | 5/1964 | Hager | 417/401 |
| 3,414,186 | 12/1968 | Jorgensen et al. . | |
| 3,572,319 | 3/1971 | Bittner et al. . | |
| 4,110,058 | 8/1978 | Langle et al. | 417/402 |
| 4,180,067 | 12/1979 | Derlien . | |
| 4,193,264 | 3/1980 | Takahashi et al. | 417/401 |
| 4,265,601 | 5/1981 | Mandroian . | |
| 4,303,376 | 12/1981 | Siekmann . | |
| 4,551,076 | 11/1985 | DuBois | 417/395 |
| 4,634,430 | 1/1987 | Polaschegg . | |
| 4,662,829 | 5/1987 | Nehring . | |
| 4,741,678 | 5/1988 | Nehring . | |
| 5,176,629 | 1/1993 | Kullas et al. . | |
| 5,261,883 | 11/1993 | Hood et al. . | |
| 5,281,108 | 1/1994 | Brooke . | |
| 5,344,292 | 9/1994 | Rabeneau et al. . | |
| 5,348,539 | 9/1994 | Herskowitz . | |
| 5,360,000 | 11/1994 | Carter . | |
| 5,368,571 | 11/1994 | Horres, Jr. . | |
| 5,380,267 | 1/1995 | Boutelle et al. . | |

FOREIGN PATENT DOCUMENTS

| | | | |
|---|---|---|---|
| 1804411 | 5/1970 | Germany | 417/395 |

*Primary Examiner*—Charles Freay
*Assistant Examiner*—Roland G. McAndrews
*Attorney, Agent, or Firm*—David P. Gordon

[57] ABSTRACT

A vacuum powered pump includes a spring biased piston or diaphragm in a vacuum chamber coupled to a source of vacuum. When vacuum is applied to the vacuum chamber, the piston or diaphragm is moved in a first direction against the spring. A delayed action valve is coupled to the vacuum chamber to allow ambient air to enter the chamber only after the piston or diaphragm has been moved a substantial distance in the first direction. When the delayed action valve opens, air enters the vacuum chamber and the force of the entering air together with the bias of the spring propels the piston or diaphragm in a second direction opposite the first direction. The delayed action valve automatically closes and the process repeats so long as a vacuum source is coupled to the vacuum chamber. The reciprocal movement of the piston or diaphragm effects a pulsatile pumping of fluid through a fluid chamber having at least one check valve.

16 Claims, 5 Drawing Sheets

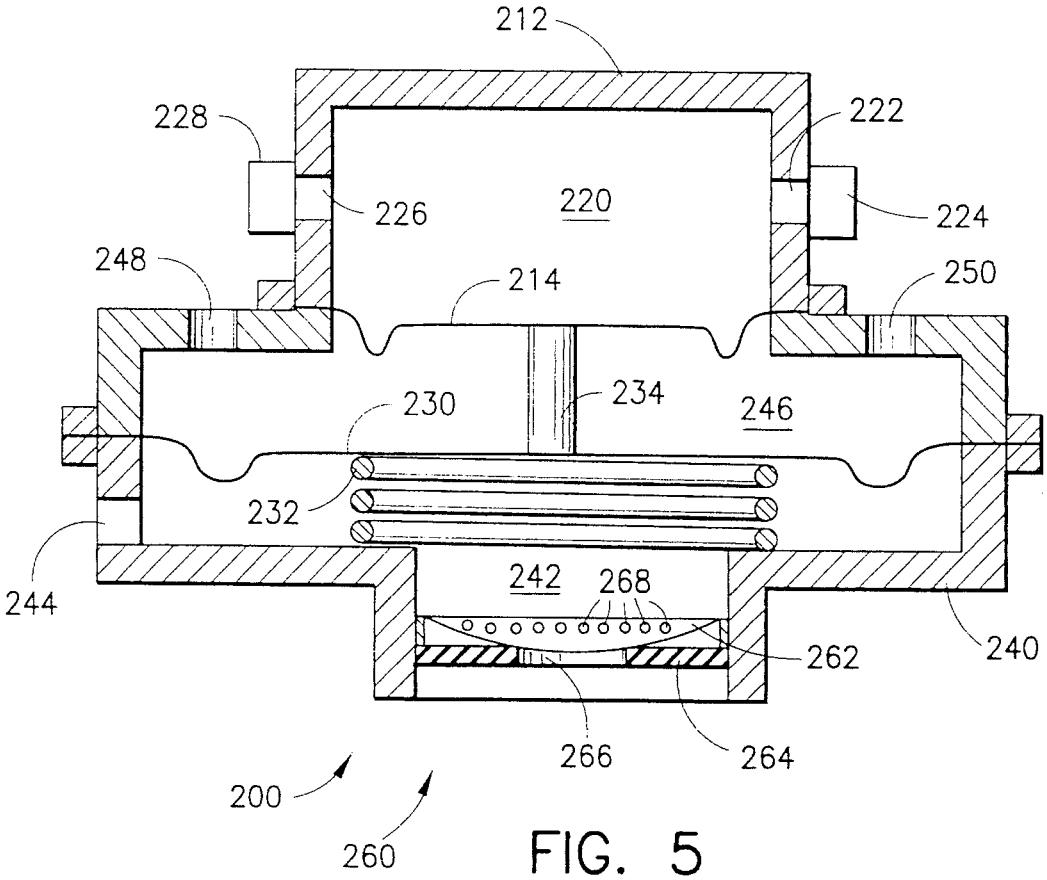
FIG. 5
FIG. 6
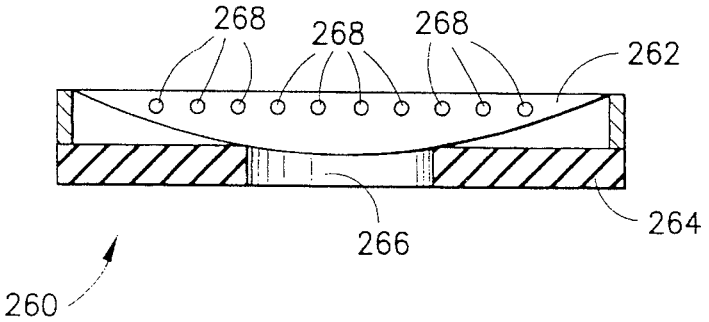
FIG. 7
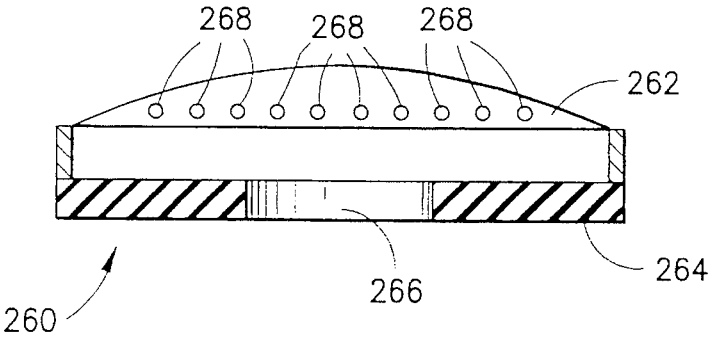

MEDICAL FLUID PUMP POWERED BY A CONSTANT SOURCE OF VACUUM

BACKGROUND OF THE INVENTION

1. Field of the Invention

The present invention relates to fluid pumps. More particularly, this invention relates to a medical irrigation fluid pump which is powered by a source of vacuum commonly available in an operating room.

2. State of the Art

Many medical procedures require the delivery of fluid under pressure or the pumping of fluid from a container through a conduit. Typical among these procedures are those which require irrigation of a surgical site. Irrigation is the washing of the surgical site with a stream of sterile water or other sterile fluid irrigant. Irrigants are supplied in containers and are delivered to the surgical site through a conduit. The most commonly used technique for delivering irrigant to the surgical site is by gravity flow from an overhead supply. Irrigation bags containing sterile irrigant are hung at a height of about six to eight feet above the patient. A tube leading from the bags is connected to an irrigation cannula. The tube is typically provided with a clamp for controlling the flow of irrigant. Although this method seems relatively easy and inexpensive to implement, the fluid pressure of the irrigant applied to the surgical site is limited by the height of the irrigation bag. Unfortunately, many procedures require that the irrigant be delivered with significantly greater pressure than is possible with the simple gravity feed. In order to increase the pressure of the irrigant, an attending nurse may be required to squeeze the irrigation bag during the course of the procedure. Alternatively, a pressure cuff may be applied to the bag and pumped with pressure, and repumped when pressure drops. Moreover, even in procedures where the pressure of gravity feed is sufficient, it is usually necessary to change irrigation bags several times during a procedure. When the irrigation bags are located considerably above the patient, changing the bags can become complicated and tedious.

In order to overcome the disadvantages of gravity feed irrigation, several types of medical pumps have been proposed. Since most operation rooms are equipped with a source of compressed gas such as air or nitrogen and/or a source of vacuum, several attempts have been made to provide a pump which is driven by positive or negative pressure. U.S. Pat. Nos. 4,662,829 and 4,741,678 to Nehring disclose several types of pulsatile two-stroke pumps which include an elastic diaphragm driven by a pressure source and one pump which uses a cylindrical elastic sleeve driven by a vacuum source. The vacuum powered pump of Nehring consists of a cylindrical canister and an internal flexible elastic sleeve with an annular vacuum chamber between the canister and the sleeve. The ends of the sleeve are hermetically sealed to the inlet and outlet of the pump, and check valves are provided at the inlet and outlet to limit fluid flow in a respective direction into and out of the sleeve. The canister is provided with a fitting for connection to a vacuum source and a spring biased valve operated by a radially inward extending stem. According to Nehring, when vacuum is applied to the canister, the annular vacuum chamber is evacuated and the elastic sleeve expands. As the sleeve expands, negative pressure is induced in the sleeve which causes the inlet check valve to open, the outlet check valve to close, and fluid to flow into the sleeve. When the sleeve expands to a certain point, it contacts the stem of the valve and opens the valve allowing air to enter the vacuum chamber. As air enters the vacuum chamber, the sleeve compresses forcing the fluid out of the sleeve through the outlet check valve. When the sleeve compresses to the point where the valve closes, the cycle repeats.

While the vacuum powered pump of Nehring seems practical in concept, the cylindrical elastic sleeve does not operate well. The effective fluid pressure imparted by the sleeve is quite low and is well under one atmosphere. Nehring achieves relatively higher output pressure, however, with positive pressure pumps. The positive pressure pumps have a circular diaphragm which overlies a source of pressure and a pressure outlet port. A pumping chamber with fluid inlet and outlet ports overlies the diaphragm. Pressure from the source of compressed air or nitrogen causes the diaphragm to rise until the pressure outlet port is exposed whereupon the diaphragm falls until the pressure outlet port is closed. The rate of pumping and the fluid pressure output is determined by the change in volume of the pumping chamber due to expansion of the diaphragm, i.e. the "stroke" of the diaphragm. In order to assure the maximum fluid pressure, the dimensions and proportions of the diaphragm, the pressure port, and the outlet port must be carefully chosen. While the positive pressure pump of Nehring is more efficient than his vacuum powered pump, it is difficult to design, and it relies on a source of pressure which may not be available.

A somewhat better solution to a pressure driven pump is provided in U.S. Pat. No. 5,281,108 to Brooke which provides a pump which is similar to that of the Nehring pump, except that the pressure outlet port is provided with a valve which is biased shut and the diaphragm is connected to the valve with a "lost motion connection". This allows the diaphragm to expand significantly more than the diaphragm of the Nehring pump before the pressure outlet opens causing the diaphragm to collapse. That is, the diaphragm of the Brooke pump has a longer stroke than that of Nehring. Brooke, however, does not disclose a vacuum powered pump and it is not evident that the design of Brooke would be compatible with the use of a vacuum as a power source.

Several other pumps have been provided in the art, such as the pumps disclosed in U.S. Pat. No. 5,261,883 to Hood et al., but these pumps are not powered by a source of constant vacuum. They rely on a "fluidic driver" which provides a pulsed source of pressure or vacuum.

SUMMARY OF THE INVENTION

It is therefore an object of the invention to provide a fluid pump which is driven by a source of vacuum.

It is another object of the invention to provide a fluid pump which is driven by a relatively constant source of vacuum and does not require a fluidic driver.

It is also an object of the invention to provide a vacuum powered pump which has a relatively high efficiency.

It is a further object of the invention to provide a vacuum powered pump having a piston or diaphragm which travels through a relatively long stroke.

Another object of the invention is to provide a vacuum powered pump which has a relatively high fluid pressure output.

A further object of the invention is to provide a vacuum powered pump which is easy to manufacture and is reliable in operation.

Yet another object of the invention to provide a vacuum powered pump which has a pulsatile output.

It is still another object of the invention to provide a vacuum powered pump which is compact and easily connected to an irrigation bag and a vacuum source.

In accord with these objects which will be discussed in detail below, the vacuum powered pump of the present invention includes a spring biased piston or diaphragm in a vacuum chamber to which is coupled a delayed action valve. When vacuum is applied to the vacuum chamber, the piston or diaphragm is moved in a first direction against the spring. The delayed action valve is coupled to the vacuum chamber to allow ambient air to enter the chamber only after the piston or diaphragm has been moved a substantial distance in the first direction. When the delayed action valve opens, air enters the vacuum chamber and the force of the entering air together with the bias of the spring propels the piston or diaphragm in a second direction opposite the first direction. The movement of the piston or diaphragm in this direction and/or the air entering the vacuum chamber automatically closes the delayed action valve, and the sequence repeats so long as a vacuum source is coupled to the vacuum chamber. The reciprocal movement of the piston or diaphragm effects a pulsatile pumping of fluid through a fluid chamber having at least one check valve.

According to a first embodiment of the invention, a pumping piston having a fluid sealing piston ring and a piston rod is disposed in a cylinder. The piston ring divides the cylinder into a first vacuum chamber and a fluid chamber. The piston rod exits the cylinder through a fluid sealing O-ring in the first vacuum chamber. A biasing spring in the first vacuum chamber urges the pumping piston toward the fluid chamber. The fluid chamber is provided with an inlet check valve and an outlet check valve and the first vacuum chamber is provided with a vacuum port. The inlet check valve is coupled to a source of irrigant and the outlet check valve is coupled to an irrigation tool. The vacuum port is coupled to a vacuum conduit which is radially coupled to a valve cylinder having a balanced spool valve with a pair of spaced apart sealing rings and a valve piston rod. The spool valve divides the valve cylinder into a second vacuum chamber defined by the space between the pair of sealing rings and a chamber having a radial opening to the atmosphere. The valve piston rod exits the chamber open to the atmosphere and is coupled to the pumping piston rod by a delay link. A source of vacuum is coupled to the second vacuum chamber.

In operation, a vacuum applied to the second vacuum chamber is applied through the vacuum conduit to the first vacuum chamber, and draws the pumping piston away from the fluid chamber against action of the spring. As the pumping piston is drawn in this direction, irrigant is drawn into the fluid chamber through the inlet check valve. After the pumping piston has moved a certain distance through this inlet stroke, the delay link coupling between the pumping piston rod and the valve piston rod effects a movement of the spool valve in the valve cylinder. When a first sealing ring of the spool valve passes over the radial coupling of the vacuum conduit, the vacuum conduit is coupled to the chamber open to the atmosphere and ambient air is permitted to flow through the vacuum conduit into the first vacuum chamber. Air entering the first vacuum chamber, together with the action of the spring, propels the pumping piston toward the fluid chamber and forces the fluid out of the fluid chamber through the outlet check valve. After the pumping piston has moved a certain distance through this outlet stroke, the delay link coupling between the pumping piston rod and the valve piston rod effects a movement of the spool valve in the valve cylinder. When the first sealing ring of the spool valve passes over the radial coupling of the vacuum conduit, the vacuum conduit is uncoupled from the chamber open to the atmosphere and ambient air is no longer permitted to flow through the vacuum conduit into the first vacuum chamber. At this point the inlet stroke begins again. Inlet and outlet strokes continue to repeat in this manner so long as a vacuum source is coupled to the second vacuum chamber. The length of the strokes may be varied by the length of the delay link between the two piston rods. During the inlet stroke, the inlet check valve opens and the outlet check valve closes. During the outlet stroke, the outlet check valve opens and the inlet check valve closes.

According to a second embodiment of the invention, a pumping piston having a fluid sealing piston ring is disposed in a fluid cylinder having a fluid inlet and a fluid outlet with inlet and outlet check valves. The piston is coupled to a diaphragm which is disposed in a generally cylindrical canister. The diaphragm is biased by a spring which urges it towards the fluid cylinder and thereby urges the piston into the fluid cylinder. A vacuum chamber is provided on the side of the diaphragm opposite the piston and the canister is open to the atmosphere on the side of the diaphragm opposite the vacuum chamber. The vacuum chamber is coupled by a conduit to a shuttle valve chamber which has a vacuum port and an air inlet port. A shuttle valve member is disposed in the shuttle valve chamber and is slidable between a first position where the vacuum port is coupled to the conduit and a second position where the air inlet is coupled to the conduit. A push rod having spaced apart flanges is slidably disposed in the valve chamber such that valve member is engageable by the spaced apart flanges. The push rod is coupled to the diaphragm so that movement of the diaphragm results in sliding movement of the push rod in the valve chamber and resulting displacement of the valve member. The spring urges the diaphragm to a first position where the push rod displaces the valve member to couple the vacuum port to the conduit and thus the vacuum chamber.

In operation, a vacuum source is coupled to the vacuum port and the vacuum chamber is evacuated thereby drawing the diaphragm against the spring and moving the piston through the fluid cylinder in an inlet stroke. During the inlet stroke, the outlet check valve is automatically closed, the inlet check valve is automatically opened, and fluid is drawn into the fluid cylinder through the fluid inlet. As the diaphragm moves through the inlet stroke, the push rod moves through the valve chamber until one of its flanges engages the shuttle valve member and slides it through the valve chamber to couple the air inlet to the conduit and thus the vacuum chamber. When the air inlet is coupled to the vacuum chamber, air rushes into the evacuated vacuum chamber and the air together with the force of the spring propels the diaphragm, and thus the piston, back to their original position in an outlet stroke. During the outlet stroke, the outlet check valve is automatically opened, the inlet check valve is automatically closed, and fluid is forced out of the fluid cylinder through the fluid outlet. As the diaphragm moves through the outlet stroke, the push rod moves through the valve chamber until the other of its flanges engages the shuttle valve member and slides it through the valve chamber to uncouple the air inlet from the conduit and thus the vacuum chamber. When the air inlet is uncoupled from the vacuum chamber, the vacuum source begins again to evacuate the chamber and a new inlet stroke commences. The length of the inlet and outlet strokes is determined by the dimensions of the shuttle valve and the spacing between the flanges on the push rod. The flanges are preferably spaced such that the valve member is only engaged at or near the end of a respective inlet or outlet stroke.

According to a third embodiment of the invention, a first diaphragm is disposed in a fluid chamber having an inlet and an outlet with respective inlet and outlet check valves. A second diaphragm is disposed in a vacuum canister, a portion of the canister on one side of the second diaphragm being open to the atmosphere and the other portion of the canister being a vacuum chamber provided with a vacuum coupling and an automatically operated air inlet valve. A spring biases the diaphragm toward the portion of the canister which is open to the atmosphere. The first and second diaphragms are mechanically coupled to each other so that movement of the second diaphragm effects a similar movement of the first diaphragm. When a source of vacuum is coupled to the vacuum coupling, the vacuum chamber is evacuated and the second diaphragm is drawn into the vacuum chamber against the spring. This draws the first diaphragm away from the fluid chamber in an inlet stroke drawing fluid into the fluid chamber through the inlet. When the second diaphragm has moved a certain distance or the negative pressure in the vacuum chamber reaches a certain level, the air inlet valve automatically opens and air enters the vacuum chamber. The air and the spring propel the second diaphragm back to its original position and thus propel the first diaphragm into the fluid chamber in an outlet stroke. When the diaphragm reaches a certain location or when pressure is equalized in the vacuum chamber, the air inlet valve automatically closes and the inlet stroke begins again.

According to the third embodiment of the invention, the air inlet valve may be pressure activated or mechanically activated. One embodiment of the valve is a snap acting dome resting in a rubber washer seal. When a predetermined vacuum is reached in the vacuum chamber, the dome snaps from its normally sealed (closed) position to allow air to enter the vacuum chamber at a relatively fast rate. Another embodiment of the valve is a flapper valve which is opened by a plunger mounted on the diaphragm.

Additional objects and advantages of the invention will become apparent to those skilled in the art upon reference to the detailed description taken in conjunction with the provided figures.

BRIEF DESCRIPTION OF THE DRAWINGS

FIG. 5 is a schematic cross sectional view of a third embodiment of the pump at an intermediate position of an inlet stroke or an outlet stroke and with a first embodiment of an automatic air inlet valve;

FIG. 6 is an enlarged view of the first embodiment of an automatic air inlet valve in the closed position;

FIG. 7 is an enlarged view of the first embodiment of an automatic air inlet valve in the open position.

DETAILED DESCRIPTION OF THE PREFERRED EMBODIMENTS

Figure 1:
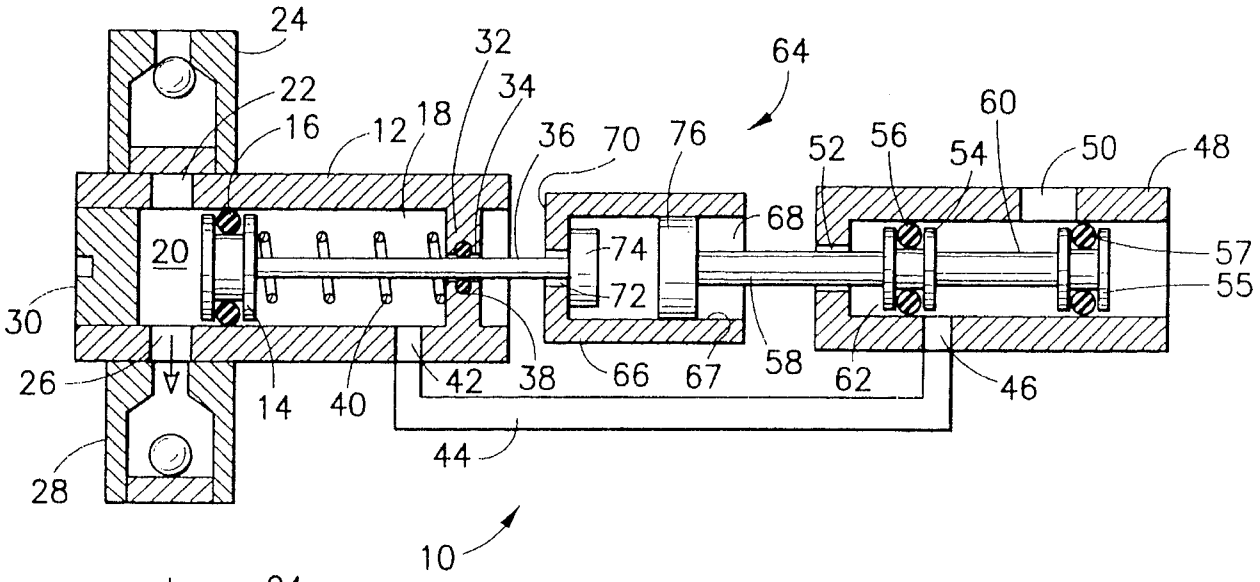
FIG. 1 is a schematic cross sectional view of a first embodiment of the pump at the end of an outlet stroke or the start of an inlet stroke.
Figure 2:
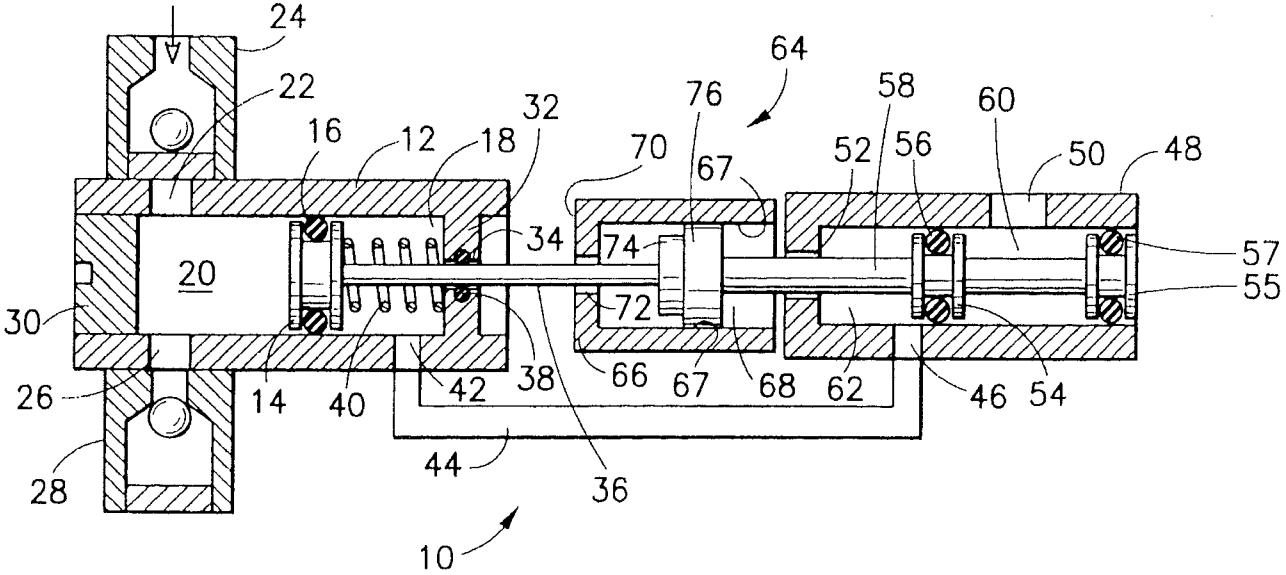
FIG. 2 is a schematic cross sectional view of a first embodiment of the pump at the end of an inlet stroke or the start of an outlet stroke.

Referring now to FIGS. 1 and 2, a first embodiment of the vacuum powered pump 10 of the invention is illustrated. Pump 10 has a first cylinder 12 with a pumping piston 14 disposed therein. The piston 14 has a fluid sealing piston ring 16 which divides the cylinder 12 into a vacuum chamber 18 and a fluid chamber 20. The fluid chamber 20 of the cylinder 12 has an inlet 22 with an inlet check valve 24 and an outlet 26 with an outlet check valve 28. The axial end of the fluid chamber 20 is preferably sealed with a screw cap 30 and the axial end of the vacuum chamber 18 has an integral base 32 with an axial bore 34. The pumping piston 14 has a piston rod 36 which extends through the axial bore 34 in the base 32 of the vacuum chamber 18. The axial bore 34 is provided with a pressure sealing O-ring 38 which seals the space between the bore 34 and the push rod 36. A coil spring 40 is coaxially disposed about the piston rod 36 in the vacuum chamber 18 and biases the piston 14 toward and into the fluid chamber 20. The rest position of the piston 14 is shown in FIG. 1 with the spring 40 extended.

The vacuum chamber 18 is also provided with a vacuum port 42 which is coupled through a conduit 44 to a radial vacuum port 46 in a valve cylinder 48. The valve cylinder 48 has a radial vacuum coupling 50 and an axial air inlet 52 which is axially spaced apart from the vacuum port 46. The air inlet 52 is also axially more distant from the vacuum coupling 50 than is the vacuum port 46. A pair of spaced apart valve pistons 54, 55 with a fluid sealing rings 56, 57 and a piston push rod 58 form a spool valve which is disposed in the valve cylinder 48 with its push rod 58 extending axially out through the axial air inlet 52. The dimensions of the air inlet 52 and the piston rod 58 are such that air freely flows through the annular space between them. The sealing rings 56, 57 divide the valve cylinder into a vacuum chamber 60, between the sealing rings and an atmospheric pressure chamber 62, between sealing ring 56 and air inlet 52. When the valve pistons 54, 55 in the position shown in FIG. 1, the sealing ring 56 is axially located between the vacuum port 46 and the air inlet 52. In this position, the vacuum coupling 50 is coupled to the vacuum port 46 and the atmospheric pressure chamber 62 is isolated from the vacuum port 46. This is the starting position for the pump 10.

The piston rod 58 of the valve pistons 54, 55 is coupled to the piston rod 36 of the pumping piston 14 through a delay link 64. As shown in FIGS. 1 and 2, the delay link 64 is an internally threaded cylinder 66 having an open end 68 and a substantially closed end 70 with an axial bore 72. The end of piston rod 36 extends through the bore 72 and is fitted with a stop disk 74. The end of piston rod 58 is provided with an externally threaded disk 76 which threadably engages the inner threads 67 of the cylinder 66.

When a source of vacuum (not shown) is applied to the vacuum coupling 50, the vacuum chamber 18 is evacuated because of the coupling of the vacuum port 42 with the vacuum port 46 via the conduit 44. Evacuation of the vacuum chamber 18 draws the pumping piston 14 against the spring 40. As the piston 14 moves in this direction, negative pressure is created in the fluid chamber 20. The negative pressure causes the inlet check valve 24 to open, the outlet check valve 28 to close, and fluid (not shown) to be drawn into the fluid chamber 20 through the inlet 22. Moreover, as the piston 14 moves in this direction, the piston rod 36 moves through the delay link 64 until the stop disk 74 contacts the threaded disk 76 and pushes the valve piston rod 58 to move the valve piston 54 towards the vacuum coupling 50. When the sealing ring 56 on the valve piston 54 passes over the vacuum port 46, as seen in FIG. 2, air from the air inlet 52 is permitted to flow into the vacuum port 46. The air flowing through port 46 is conducted by the conduit 44 into the vacuum chamber 18. The air and the spring 40 force the piston 14 back to its original position, shown in FIG. 1. As the piston 14 moves in this direction, positive pressure is created in the fluid chamber 20. This causes the inlet check valve. 24 to close, the outlet check valve 28 to open, and fluid (not shown) to be driven out of the fluid chamber 20 through the outlet 26. Moreover, as the piston 14 moves in this direction, the piston rod 36 moves through the delay link 64 until the stop disk 74 contacts the end 70 of the cylinder 66 and pulls the valve piston rod 58 to move the valve piston 54 away from the vacuum coupling 50. When the sealing ring 56 on the valve piston 54 passes back over the vacuum port 46, as seen in FIG. 1, air from the air inlet 52 is no longer permitted to flow into the vacuum port 46. In this position, vacuum applied to the vacuum port 50 is again conducted to the vacuum chamber 18 and the piston begins another inlet stroke.

From the foregoing, it will be appreciated that the length of the stroke of the pumping piston 14 may be adjusted by turning the internally threaded cylinder 66 to increase or decrease the distance between the threaded disk 76 and the end 70 of the cylinder 66.

Figure 3:
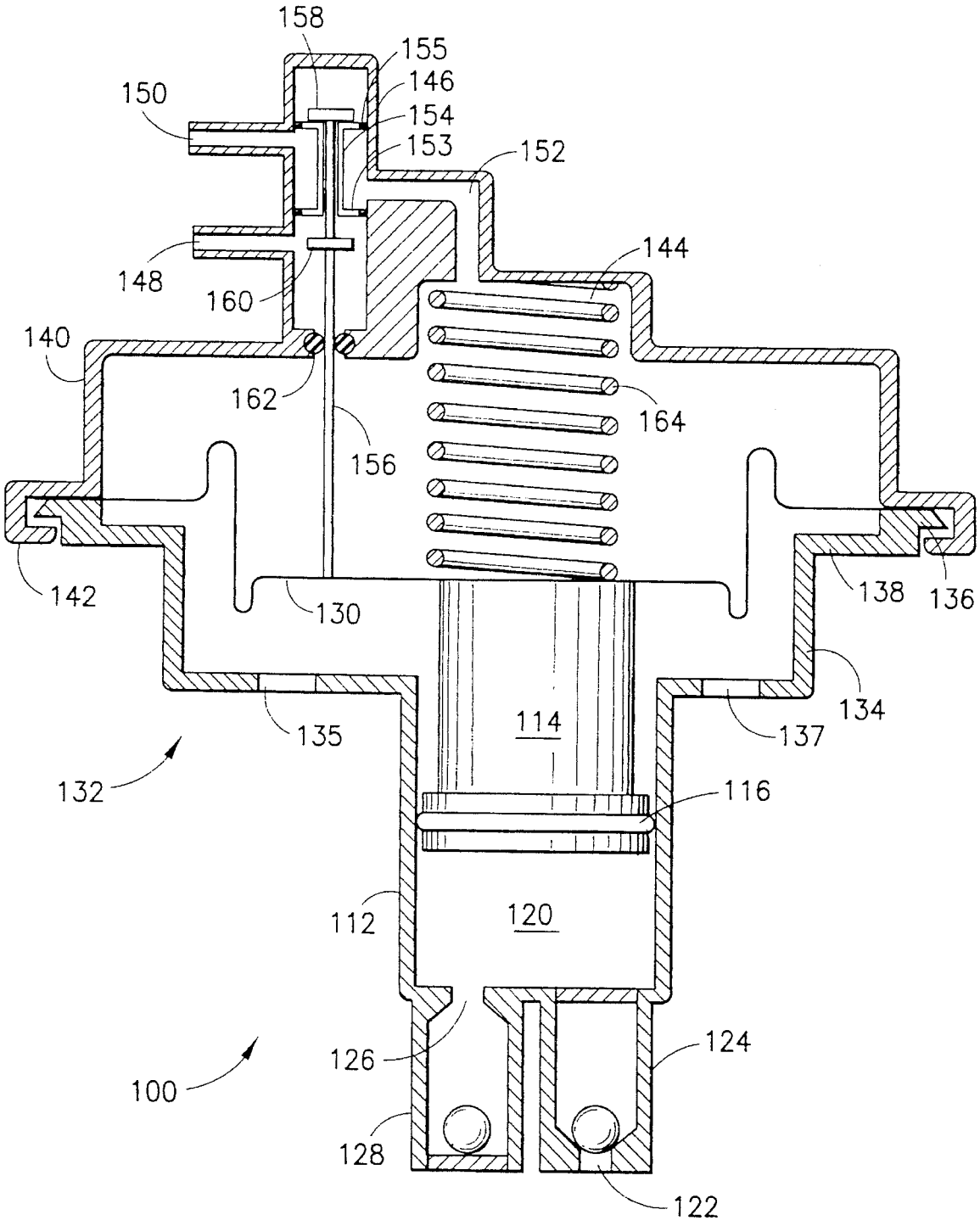
FIG. 3 is a schematic cross sectional view of a second embodiment of the pump at the end of an outlet stroke or the start of an inlet stroke.
Figure 4:
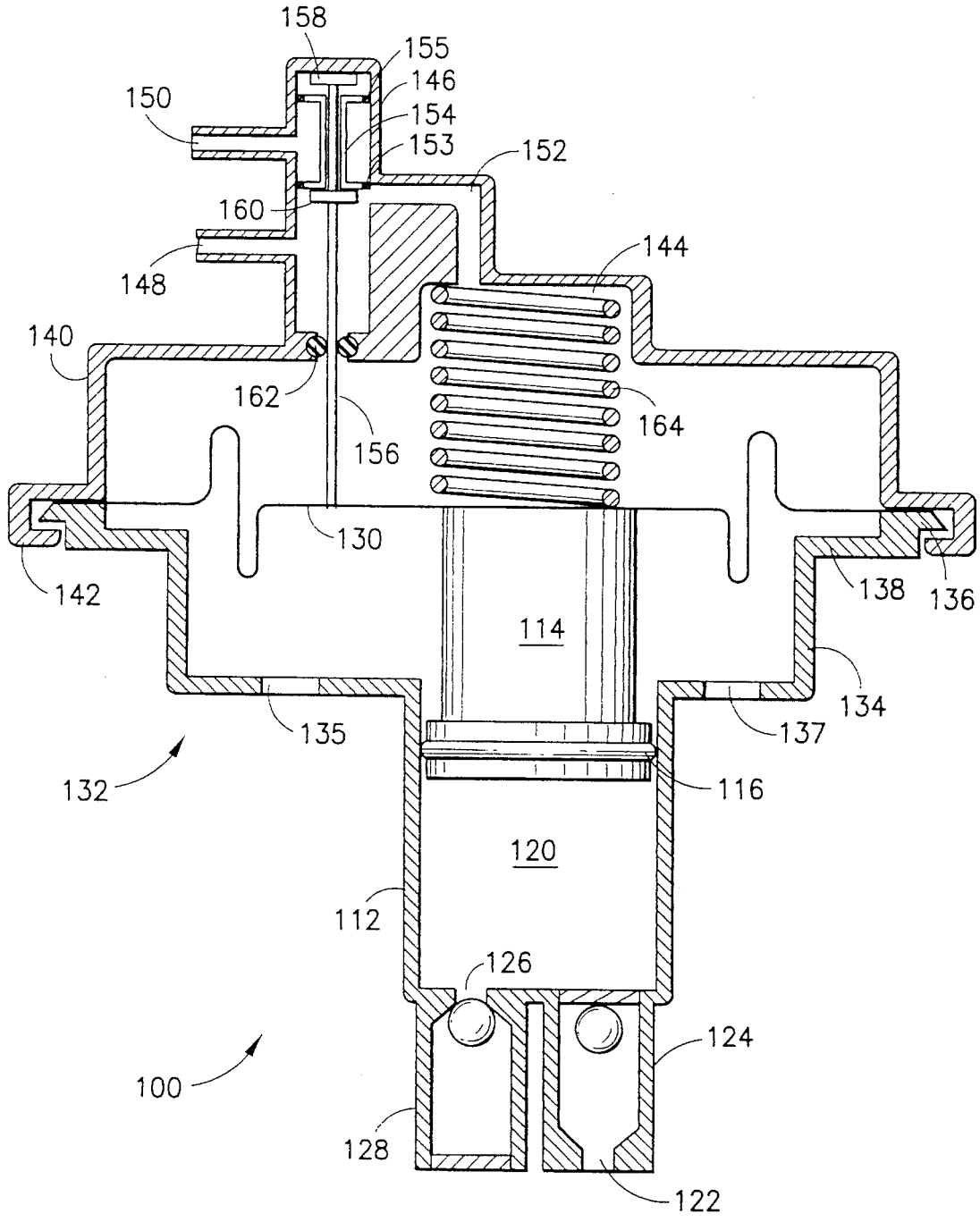
FIG. 4 is a schematic cross sectional view of a second embodiment of the pump at the end of an inlet stroke or the start of an outlet stroke.

Turning now to FIGS. 3 and 4, a second embodiment of the vacuum powered pump 100 has a fluid cylinder 112 and a pumping piston 114 disposed therein. The piston 114 has a fluid sealing piston ring 116 defining a fluid chamber 120 within the fluid cylinder 112. The cylinder 112 is also provided with a fluid inlet 122 having an inlet check valve 124 and a fluid outlet 126 having an outlet check valve 128. The piston 114 is coupled to a diaphragm 130 which is disposed in a generally cylindrical canister 132. According to the presently preferred embodiment, the canister 132 is preferably formed from a wide mouth continuous extension 134 of the cylinder 112 and a wide mouth vacuum cylinder 140 which couples to the extension 134. The extension 134 is provided with a ramped locking flange 136 and an interior diaphragm step 138 and is open to the atmosphere via vents 135, 137. The vacuum cylinder 140 has a peripheral locking lip 142, a central spring seat 144, and a shuttle valve chamber 146. The shuttle valve chamber 146 has a vacuum port 150, an air inlet 148, and a conduit 152 coupling it to the interior of the vacuum cylinder 140. A shuttle valve member 154 with sealing rings 153, 155 is slideably disposed inside the shuttle valve chamber 146. A shuttle valve push rod 156 having a pair of spaced apart flanges 158, 160 is disposed inside the valve chamber 146 and extends from the valve chamber 146 into the vacuum cylinder 140 through a sealing O-ring 162. The diaphragm 130 is supported between the locking flange 136 and the locking lip 142 and is biased towards the fluid cylinder 112 by a spring 164 which is seated in the spring seat 144 of the vacuum cylinder 140. The end of the push rod 156 is coupled to the diaphragm 130 so that movement of the diaphragm results in movement of the push rod 156. In the rest, or starting position shown in FIG. 3, the shuttle valve member 154 fluidly couples the interior of the vacuum cylinder 140 with the vacuum port 150 and fluidly seals the cylinder 140 from the air inlet 148.

When vacuum is applied to the vacuum port 150, the interior of the vacuum cylinder 140 is evacuated and the diaphragm 130 is drawn into the vacuum cylinder 140 against the bias of the spring 164. This results in the piston 114 being drawn through the fluid cylinder 112 in an inlet stroke to create negative pressure in the fluid chamber 120. The negative pressure in the fluid chamber 120 closes the outlet check valve 128, opens the check valve 124, and draws fluid into the chamber 120 from the inlet 122. As the diaphragm is drawn into the vacuum cylinder 140, the push rod 156 is moved through the shuttle valve chamber 146 until the flange 160 engages the valve member 154 and pushes it away from the conduit 152. As the diaphragm 130 continues to move under the action of the vacuum, the shuttle valve member 154 continues to be moved by the push rod 156. When the diaphragm 130 has reached a certain position, as shown in FIG. 4, the shuttle valve fluidly couples the air inlet 148 with the conduit 152 and thus the interior of the vacuum cylinder 140. Ambient air is then allowed to enter the evacuated vacuum cylinder 140. The air and the spring 164 propel the diaphragm 130 back to its original position which is shown in FIG. 3. As the diaphragm 130 moves out of the vacuum cylinder, the piston 114 moves through the fluid cylinder 112 in an outlet stroke exerting positive pressure in the fluid chamber 120, forcing the outlet check valve 128 open, the inlet check valve 124 closed, and forcing fluid out of the chamber 120 through the outlet 126. This movement of the diaphragm 130 also moves the push rod 156 until the flange 158 engages the valve member 154 and returns the valve member to the starting position where the air inlet 148 is sealed from the vacuum cylinder 140. After returning to this position, the process is repeated with a new inlet stroke and continues to be repeated so long as a vacuum is applied to the vacuum port 150.

Referring now to FIGS. 5 through 7, a third embodiment of the vacuum powered pump 200 has a first diaphragm 214 disposed in a first cylinder 212 defining a fluid chamber 220 having an inlet 222 with an inlet check valve 224 and an outlet 226 with an outlet check valve 228. A second diaphragm 230 is disposed in a second cylinder 240 having a vacuum chamber 242 with a vacuum port 244 and a vented chamber 246 having air vents 248, 250 open to the atmosphere. The second diaphragm 230 is biased by a spring 232 towards the vented chamber 246, and is mechanically coupled to the first diaphragm 214 by a relatively rigid member 234. As will be explained in detail below, the second diaphragm 230 preferably has a larger diameter than the first diaphragm 214. An automatically operated air inlet valve 260 is provided in the vacuum chamber 242 and opens to allow air into the vacuum chamber after a certain negative pressure level is achieved in the vacuum chamber 242.

When a source of vacuum is applied to the vacuum port 244, the vacuum chamber 242 is evacuated and the second diaphragm 230 is drawn in a first direction against the spring 232. The relatively rigid member 234 which mechanically couples the second diaphragm 230 to the first diaphragm 214 causes the first diaphragm 214 to move in an inlet stroke when the second diaphragm 230 is being drawn in the first direction. During the inlet stroke, the check valves 224, 228 open and close as described above with reference to the other embodiments and fluid is drawn into the fluid chamber 220 through the inlet 222.

When the negative pressure in the vacuum chamber 242 reaches a predetermined level, the air inlet valve 260 automatically opens and allows air to enter the vacuum chamber 242. The entering air and the spring 232 propel the second diaphragm 230 in a second direction towards the vented chamber 246. The relatively rigid member 234 which mechanically couples the second diaphragm 230 to the first diaphragm 214 causes the first diaphragm 214 to move in an outlet stroke when the second diaphragm 230 is being propelled in the second direction. During the outlet stroke, the check valves 224, 228 close and open as described above and fluid is forced out of the fluid chamber 220 through the outlet 226. When the negative pressure in the vacuum chamber 242 is equalized, the valve 260 closes and the process repeats with a new inlet stroke.

According to one version of the third embodiment 200, the valve 260 is embodied as a snap-acting dome 262 which is biased against a rubber washer seal 264 having a central opening 266. The dome is provided with a plurality of air holes 268 which are spaced outward from the pole of the dome. When the valve is closed, a portion of the dome between the pole and the air holes engages the central opening 266 of the washer 264 and provides a tight seal. When the valve opens, the pole of the dome is inverted and thus moved away from the central opening 266 and air flows into the opening 226 and through the holes 268 into the vacuum chamber 242. Those skilled in the art will appreciate that in lieu of the holes 268 in the dome 262, other means such as conduits (not shown) may be used to conduct air from the space between the dome and the washer into the vacuum chamber.

Figure 8:
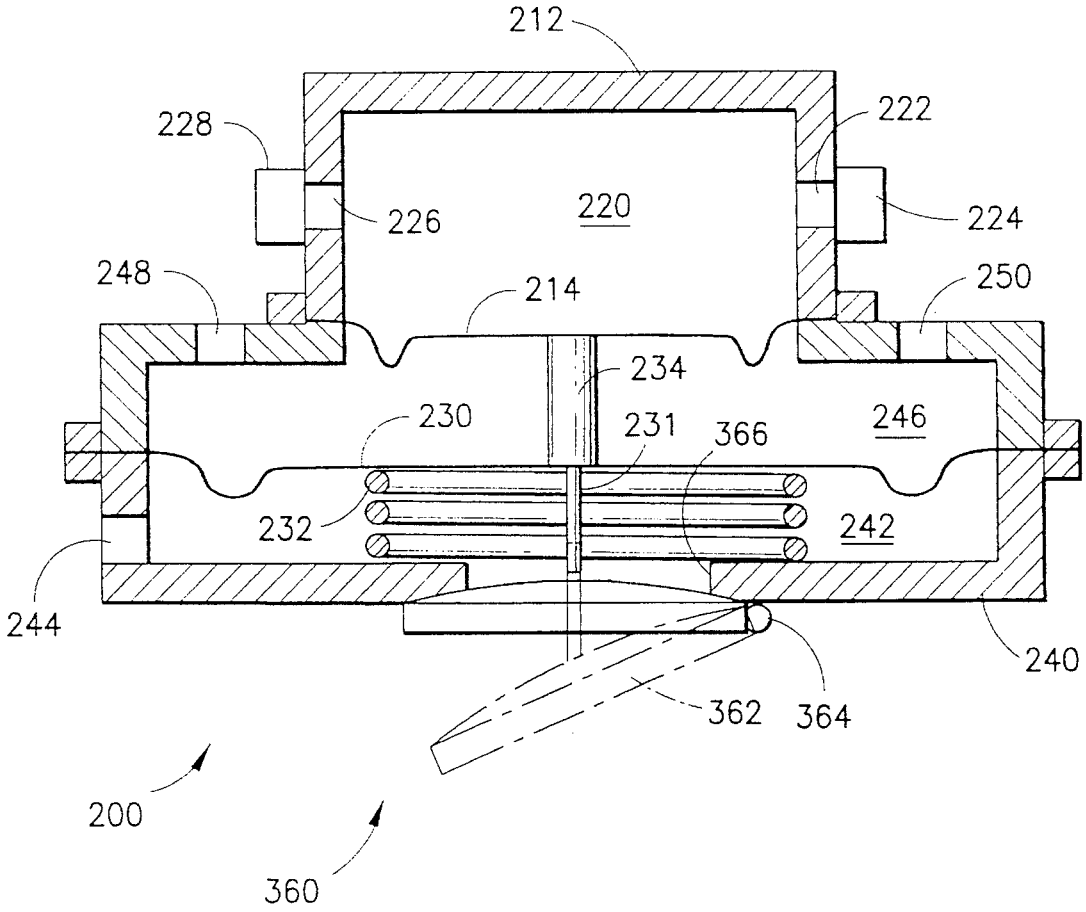
FIG. 8 is a schematic cross sectional view of the third embodiment of the pump at an intermediate position of an inlet stroke or an outlet stroke and with a second embodiment of an automatic air inlet valve.

FIG. 8 shows another version of the third embodiment 200 where the valve 360 is embodied as a flapper valve 362 biased by a spring 364 to close and seal an opening 366 in the second cylinder 240 opening into the vacuum chamber 242. In this version of the third embodiment, the second diaphragm 230 is provided with a plunger 231 for activating the flapper valve 362. With this type of valve, the stroke of the diaphragms is determined by the length of the plunger rather than the pressure differential in the vacuum chamber. It will be appreciated that in both versions of the third embodiment, a restrictor in the vacuum port 244 may be used to vary the timing of the inlet and outlet strokes.

The pumps 10, 100, and 200 are able to generate more fluid pressure than the difference in pressure between the vacuum source and the atmospheric pressure because of the different diaphragm/piston sizes. For example, if the first diaphragm or piston 14, 114, 214 has a diameter of 0.5 inches and the second diaphragm or piston 54, 130, 230 has a diameter of 1.0 inches, the fluid output pressure of the pump 10, 100, 200 at the outlet 26, 126, 226 will be approximately four times the differential pressure of the vacuum source as compared to the atmosphere. This is because the surface area of the second diaphragm/piston is approximately four times the surface area of the first diaphragm/piston. For example, a typical vacuum source may provide a vacuum of approximately twenty-four inches (Hg) which is equivalent to a pressure differential of 11.8 $lb/in^2$ less than atmospheric pressure. With such a typical vacuum source, the exemplary diaphragms/pistons of the dimensions stated will produce a fluid output at the outlet having a fluid pressure of approximately 47.2 $lb/^2$.

There have been described and illustrated herein several embodiments of a vacuum powered fluid pump. While particular embodiments of the invention have been described, it is not intended that the invention be limited thereto, as it is intended that the invention be as broad in scope as the art will allow and that the specification be read likewise. Thus, while particular diaphragms and pistons have been disclosed, it will be appreciated that other diaphragms or pistons could be utilized. For example which piston-piston, piston-diaphragm and diaphragm-diaphragm embodiments have been shown, a diaphragm-piston embodiment could be used as well. The shapes and dimensions of the pistons and/or diaphragms can also be varied. Also, while springs have been shown for biasing, it will be recognized that other types of biasing devices could be used with similar results obtained. Moreover, while the particular configurations have been disclosed with reference to cylinders, it will be appreciated that non-cylindrical configurations could be used as well. It will therefore be appreciated by those skilled in the art that yet other modifications could be made to the provided invention without deviating from its spirit and scope as so claimed.

We claim:

1. A vacuum powered pump comprising:

a) a fluid chamber having an inlet and an outlet;

b) a first displacement means movable in said fluid chamber from a first position to a second position for creating negative pressure in said fluid chamber and movable from said second position to said first position for creating positive pressure in said fluid chamber;

c) biasing means for biasing said first displacement means toward said first position;

d) a vacuum chamber having a vacuum port for coupling with a source of vacuum to provide negative pressure in said vacuum chamber, said first displacement means being responsive to negative pressure in said vacuum chamber such that negative pressure in said vacuum chamber causes said displacement means to move from said first position to said second position; and e) a delayed action valve fluidly coupled to said vacuum chamber and mechanically coupled to said first displacement means for allowing ambient air to enter said vacuum chamber when said first displacement means is in said second position and to remain open until said displacement means returns to said first position, wherein said delayed action valve comprises a cylinder having an air inlet port and a displaceable member within said cylinder, said displaceable member having at least one sealing ring separating said air inlet port from said vacuum chamber when said displacement means is in said first position.

2. A vacuum powered pump according to claim 1, further comprising:

f) at least one check valve coupled to one of said inlet and said outlet.

3. A vacuum powered pump according to claim 1, wherein:

said biasing means comprises a spring.

4. A vacuum powered pump according to claim 1, wherein:

said delayed action valve is coupled to said first displacement means by a push rod.

5. A vacuum powered pump according to claim 1, wherein:

said delayed action valve at least partially blocks said vacuum port when allowing ambient air to enter said vacuum chamber.

6. A vacuum powered pump according to claim 1, wherein:

said first displacement means comprises a first piston having a first fluid sealing piston ring.

7. A vacuum powered pump according to claim 6, wherein:

said fluid chamber and said vacuum chamber are contiguous.

8. A vacuum powered pump according to claim 7, wherein:

said first piston has a first piston rod, said delayed action valve comprises a piston valve having a second piston with a second piston rod, and said first piston rod is coupled to said second piston rod through a delay link.

9. A vacuum powered pump according to claim 8, wherein:

said biasing means comprises a coil spring which is substantially coaxial to said first piston rod.

10. A vacuum powered pump according to claim 1, further comprising:

f) second displacement means movable in said vacuum chamber from a first position to second position in response to negative pressure in said vacuum chamber and from said second position to said first position in response to said delayed action valve opening, said second displacement means being mechanically coupled to said first displacement means.

11. A vacuum powered pump according to claim 10, wherein:

said biasing means comprises a spring in said vacuum chamber, said spring biasing said second displacement means toward said first position.

12. A vacuum powered pump according to claim 10, wherein:

said fluid chamber is substantially cylindrical and has a wide mouth continuous extension with one of a flange and a lip, and said vacuum chamber is substantially cylindrical and has the other of a flange and a lip, said flange engaging said lip to couple said wide mouth continuous extension of said fluid chamber to said vacuum chamber.

13. A vacuum powered pump according to claim 12, wherein:

said delayed action valve further comprises a push rod with a pair of spaced apart flanges for moving said displaceable member, said push rod being mechanically coupled to said second displacement means.

14. A vacuum powered pump according to claim 10, wherein:

said first displacement means comprises a piston having a fluid sealing piston ring.

15. A vacuum powered pump according to claim 14, wherein:

said second displacement means comprises a diaphragm.

16. A vacuum powered pump according to claim 15, wherein:

said delayed action valve further comprises a push rod with a pair of spaced apart flanges for moving said displaceable member, said push rod being mechanically coupled to said diaphragm.

* * * * *